US008328953B2

(12) United States Patent
Vitan et al.

(10) Patent No.: US 8,328,953 B2
(45) Date of Patent: Dec. 11, 2012

(54) APPLIANCE DEVICE WITH MOTORS RESPONSIVE TO SINGLE-PHASE ALTERNATING CURRENT INPUT

(75) Inventors: Craig Robert Vitan, Louisville, KY (US); Derek Lee Watkins, Elizabeth, KY (US); Ronald Scott Tarr, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/965,960

(22) Filed: Dec. 13, 2010

(65) Prior Publication Data

US 2012/0048314 A1 Mar. 1, 2012

(51) Int. Cl.
*B08B 3/02* (2006.01)

(52) U.S. Cl. ..... 134/57 D; 134/58 D; 134/184

(58) Field of Classification Search ..... 134/56 D, 134/58 D, 198, 179, 57 D, 184
See application file for complete search history.

(56) References Cited

U.S. PATENT DOCUMENTS

| | | | | |
|---|---|---|---|---|
| 5,234,319 | A * | 8/1993 | Wilder | 417/40 |
| 5,429,146 | A | 7/1995 | Graf et al. | |
| 5,525,161 | A * | 6/1996 | Milocco et al. | 134/18 |
| 5,711,542 | A * | 1/1998 | Kendall | 280/491.4 |
| 6,051,952 | A * | 4/2000 | Moreira et al. | 318/738 |
| 7,621,286 | B2 * | 11/2009 | Frei et al. | 134/129 |
| 7,681,582 | B2 | 3/2010 | Wetzel et al. | |
| 2003/0034749 | A1 * | 2/2003 | Zinke et al. | 318/440 |
| 2004/0079400 | A1 * | 4/2004 | Young | 134/57 D |
| 2006/0237044 | A1 | 10/2006 | Ferguson et al. | |
| 2007/0151579 | A1 | 7/2007 | Hooker et al. | |
| 2007/0181154 | A1 * | 8/2007 | Beer et al. | 134/18 |
| 2007/0295361 | A1 | 12/2007 | Thiyagarajan et al. | |
| 2009/0087319 | A1 * | 4/2009 | Russold et al. | 417/45 |
| 2009/0178698 | A1 * | 7/2009 | Delgado | 134/57 D |
| 2010/0186772 | A1 * | 7/2010 | Hatfield et al. | 134/18 |
| 2010/0310382 | A1 * | 12/2010 | Kidd et al. | 417/12 |
| 2011/0018474 | A1 * | 1/2011 | Harhay et al. | 318/82 |

FOREIGN PATENT DOCUMENTS

GB 2253341 A 9/1992

OTHER PUBLICATIONS

WIPO WO 2010/121407 Oct. 2010.*

* cited by examiner

*Primary Examiner* — Frankie L Stinson
(74) *Attorney, Agent, or Firm* — Global Patent Operation

(57) ABSTRACT

An appliance for washing objects in which is employed a pump system for varying the spray velocity of washing fluid dispensed from spray jets affixed at an angle relative to a spray arm. In one embodiment, the pump system includes a pump having a pump motor such as a synchronous motor responsive to a variable frequency, single-phase alternating current input. The pump system also includes a pump motor control circuit configured to vary the frequency and voltage of the input, which in one example effectuates changes in the rotational speed of the pump motor in accordance with one or more operational cycles. The pump motor control circuit incorporates in one example a rectifier and an inverter that permits operation of the appliance when coupled to supply mains.

14 Claims, 7 Drawing Sheets

APPLIANCE DEVICE WITH MOTORS RESPONSIVE TO SINGLE-PHASE ALTERNATING CURRENT INPUT

BACKGROUND OF THE INVENTION

The subject matter disclosed herein relates generally to appliances and, more particularly, to pump motors and control circuitry used to dispense a washing fluid throughout the appliance.

Pump systems in appliances such as dishwashers use different configurations of pump motors and control circuitry to dispense a washing fluid for cleaning objects (e.g., dishes and dishware). Many configurations utilize almost exclusively single-phase motors (e.g., asynchronous and synchronous motors) in connection with compatible control schemes. However, because these motors and control schemes are relatively simple and limited as to the tasks to be performed (i.e., dispensing the washing fluid), the appliance is provided with only a finite number and variations of operational cycles that define one or more spray properties (e.g., spray velocity). For effective cleaning of objects disposed in the dishwasher, these operational cycles typically require optimization of physical components of the dishwasher such as the spray arms and associated spray jets.

Limitations of single-phase motors often preclude their implementation in and use for design-related improvements such as those improvements that address demands for better wash performance, improved energy efficiency, and advanced features found in sophisticated appliances directed at "high end" markets. These limitations include inadequate speed control, low starting torques, and a lack of feedback as to the motor state (e.g., speed, torque, and power draw). Single-phase motors are also less efficient, as compared to other solutions, and such reduced efficiency can cause heat, which must be dissipated by fans, vents, or louvers such as in the motor compartment that houses the pump. Moreover, single-phase motors often exhibit vibration during operation, which can cause torque pulsations. These vibrations and/or torque pulsations are transmitted to the structure of the dishwasher and ultimately generate acoustical noise at levels that is difficult to control and not acceptable for consumer products such as household dishwashers.

Because of the perceived limitations with single-phase motors, other types of motors are often used to improve the performance of appliances. These motors include variable speed motors and, in particular, three-phase motors that require associated motor controllers. Such configurations overcome the limitations of single-phase motors but add cost and complexity.

Therefore there is a need for a solution that utilizes single-phase motors to achieve improved functionality of appliances.

BRIEF DESCRIPTION OF THE INVENTION

The concepts of the present disclosure are advantageous because such concepts permit use of single-phase motors in the pump system of appliances such as dishwashers. Implementation of one or more of the concepts, discussed in more detail below, provides performance comparable to appliances configured with variable speed and three-phase motors. These concepts improve performance of the appliance without increasing the cost or the complexity of the pump system or the resulting appliance.

Further discussion of these concepts, briefly outlined above, is provided below in connection with one or more embodiments.

In one embodiment, an appliance comprises a pump configured to pressurize a washing fluid and a spray arm in fluid communication with the pump. The spray arm comprises a spray jet through which flows the washing fluid at a spray velocity and an angle fixed relative to the spray arm. The appliance also comprises a pump motor control circuit coupled to the pump and configured to generate a variable frequency, single-phase alternating current input. In one example, the pump is configured to change the spray velocity of the washing fluid in response to the variable frequency, single-phase alternating current input.

In another embodiment, an appliance comprises a first spray arm and a second spray arm, each having a spray jet through which a washing fluid is dispersed at a spray velocity and a fixed angle. The appliance also comprises a pump system configured to pressurize the washing fluid and a controller coupled to the pump system to impress upon the pump system a variable frequency, single-phase alternating current input. In one example, the pump is configured to change the spray velocity of the washing fluid in response to the variable frequency, single-phase alternating current input.

In yet another embodiment, an appliance comprises a spray arm configured to disperse a washing fluid at a spray velocity and angle that is fixed relative to the spray arm. The appliance also comprises a pump in fluid communication with the spray arm, the pump comprising a pump motor responsive to a variable frequency, single-phase alternating current input. The appliance further comprises a pump stabilizer coupled to the pump motor. In one example, the pump is configured to change the spray velocity of the washing fluid in response to the variable frequency, single-phase alternating current input.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Illustrated in the appended drawings are embodiments of an appliance, which are configured to dispense a washing fluid onto objects, e.g., dishes and dishware. One embodiment of the appliance utilizes a number of spray jets constructed at a fixed angle, wherein the angle is fixed relative to a rotatable spray arm, and a pump system for pumping the washing fluid to the spray jets. This combination dispenses the washing fluid at a fixed angle and with a spray velocity, and more particularly the configuration of the pump system is selected so as to vary the spray velocity of the fluid ejected from the spray jets.

However, whereas the variation in spray velocity is often achieved with variable-position spray jets (i.e., spray jets that move relative to the rotatable spray arm) or pump motors responsive to a three-phase alternating current ("AC") input, the inventors propose configurations of the pump system that utilize in one example spray jets at a fixed angle, a single-phase AC input, and a single-phase pump motor. By employing such combinations, examples of which can also comprise circuitry for varying properties of the single-phase AC input impressed upon the pump motor, the inventors have reduced the cost and complexity of the resulting appliance. Moreover, as illustrated in the EXPERIMENTAL SECTION below, although simplified, the proposed implementations can achieve levels of cleanliness comparable to these conventional appliance arrangements.

Figure 1:
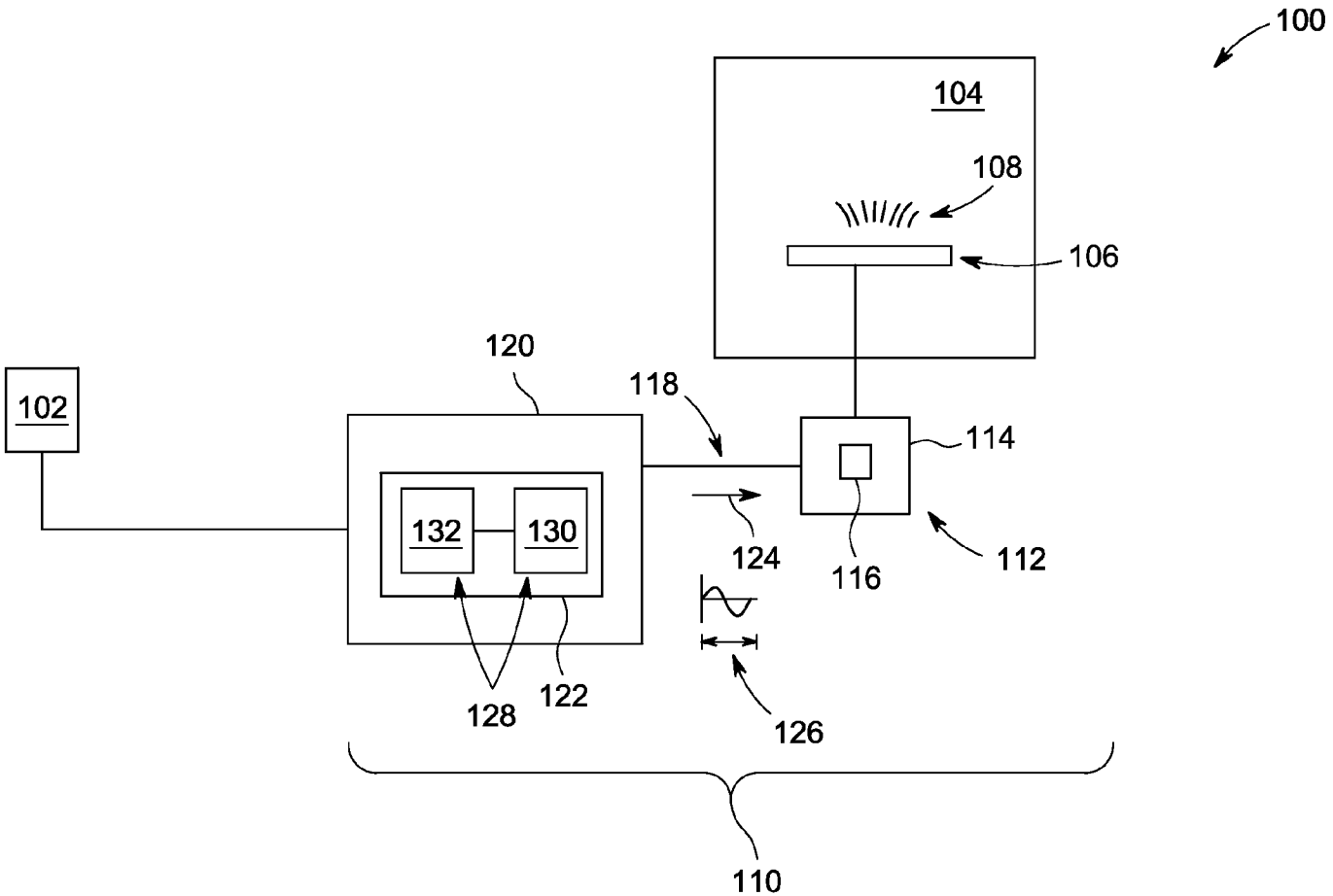
FIG. 1 is a schematic diagram of an embodiment of an appliance for washing objects.

To begin the discussion, reference is now directed to the schematic diagram of FIG. 1, in which there is depicted an exemplary embodiment of an appliance 100. The appliance 100 is coupled to a supply mains 102 such as the AC power supply that is found in a premise where the appliance 100 is installed. Premises include residential properties such as a house or an apartment, as well as commercial buildings such as office buildings.

The appliance 100 includes a wash zone 104, in which is disposed a spray system 106 for dispensing a washing fluid 108 therein. A fluid distribution system 110 is also provided, in which a pump system 112 is coupled to the spray system 106 to distribute the washing fluid 108 within the wash zone 104. The pump system 112 includes at least one pump 114 with a pump motor 116 that is responsive to an input 118 from a controller 120. The controller 120 is coupled to the supply mains 102, and includes a pump motor control circuit 122 that is configured to provide the input 118 to the pump motor 116, and in one embodiment the input 118 includes a single-phase AC input 124 with a frequency 126, which can vary as discussed in more detail below.

Focusing first on the fluid distribution system 110, pumps for use as the pump 114 are typically sized to provide at least about 15 gal/min, with the pump 114 in one construction of the appliance 100 being configured to provide from about 6 gal/min to about 18 gal/min. The pump 114 is coupled to the pump motor 116, which as mentioned above operates at a variety of rotational speeds under influence of the single-phase AC input 124. These motors include synchronous motors that are responsive to alternating current such as the single-phase AC input 124 and which in one example employ permanent magnet rotors and wound coil stators. As implemented in the appliance 100, the motors selected for the pump motor 116 are rated for at least about 150 watts, with the pump motor 116 in one particular construction of the appliance 100 being rated at 170 watts. In one example, the pump motor 116 is a shaded pole motor. This pump motor is compatible with and/or works in conjunction with one or models of pump bodies provided by, for example, General Electric of Fairfield, Conn. The pump bodies are sized and configured to provide the flow rates and other parameters required for use with the appliance 100 and related embodiments contemplated herein.

In one embodiment, the pump motor 116 is configured to respond to changes in the frequency 126 of the single-phase AC input 124, which can influence the rotational speed of the pump motor 116. Changes to the rotational speed modify operation of the pump 114, which can increase and decrease the flow rate of the washing fluid 108 pressurized by the pump 114 and provided to the spray system 106. These changes effectuate corresponding changes in the spray velocity of the washing fluid 108 that is dispersed into the wash zone 104 from the spray system 106. In one embodiment, the pump 114, the pump motor 116, and the pump motor control circuit 122 are configured so the flow rate is a least about 12 gal/min, varies by at least about ±6 gal/min, and/or varies from about 6 gal/min to about 18 gal/min. While values for the frequency 126 can vary in connection with the ratings and related characteristics of the pump motor 116, the pump motor control circuit 122 is configured to vary the frequency 126 by at least about ±30 Hz, and in one construction the frequency 126 varies from about 40 Hz to about 100 Hz.

Referring back to FIG. 1, in one embodiment, the pump motor control circuit 122 is configured with component circuitry 128 such as an inverter circuit 130 and a rectifier circuit 132. This combination permits operation of the pump motor 116 using power supplied via the supply mains 102. In one operative example, the rectifier circuit 132 such as a rectifier or a converter bridge converts power supplied by the supply mains 102 to a direct current (DC) input. This DC input is thereafter received by the inverter circuit 130, which is for example an H-bridge or related inverter device, and which is configured to convert the DC input to AC input such as the single-phase AC input 124 described herein. These features can also be embodied in the form of a variable-frequency drive, which in one example is a device that is used to control the speed of AC electric motors such as the pump motor 116. Devices similar to the variable-frequency drive also include or are recognized as an adjustable-frequency drive ("AFD"), a variable-speed drive ("VSD"), a variable-voltage variable-frequency drive ("VvVf"), an AC drive, a micro-drive, and an inverter. Each of these devices is configured to vary frequency and voltage of an AC input such as the single-phase AC input 124.

Figure 2:
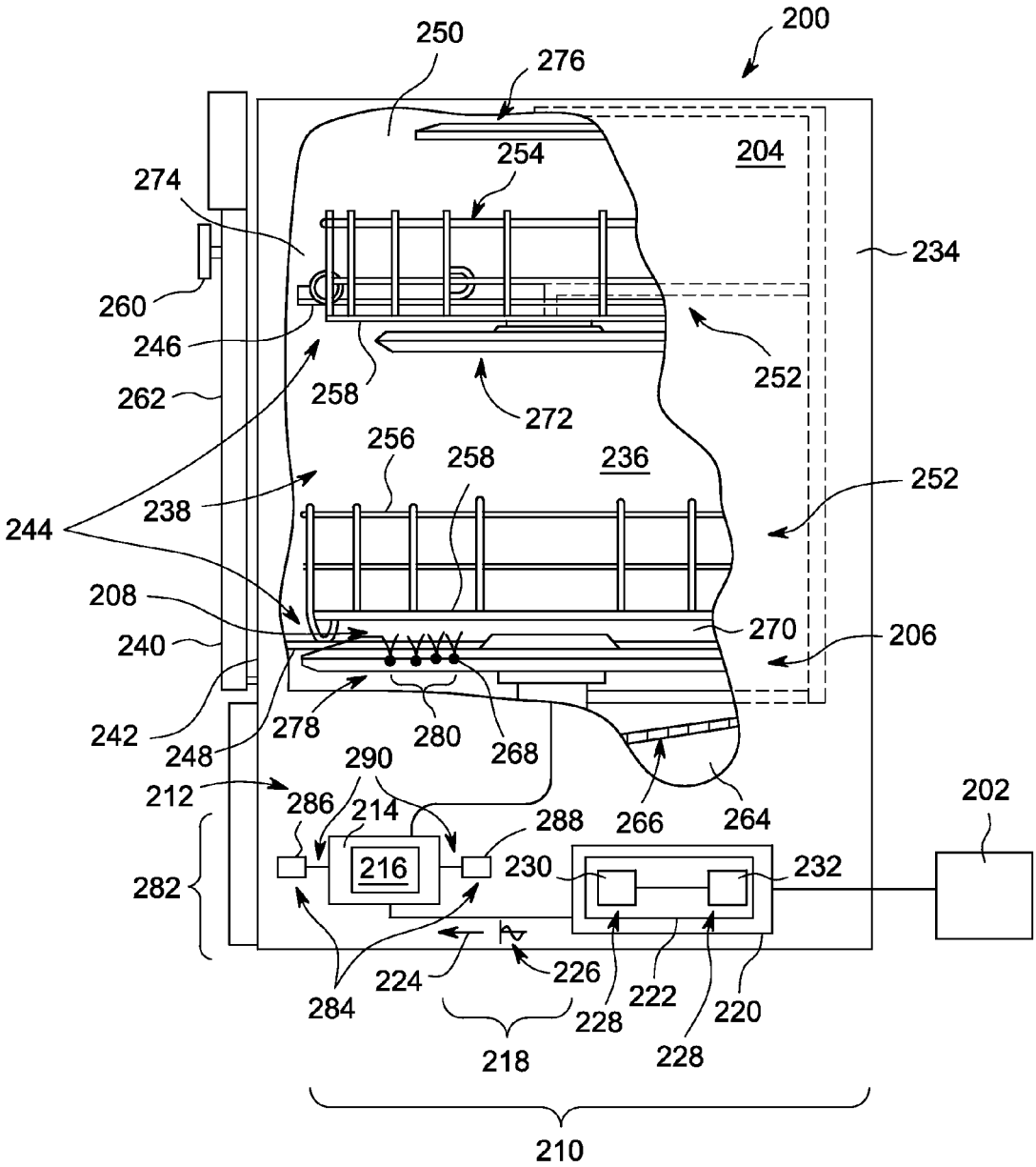
FIG. 2 is a side elevation, partially broken away view of another exemplary embodiment of an appliance for washing objects.

These concepts are further described below in connection with FIG. 2 in which there is depicted another exemplary embodiment of an appliance 200. FIG. 2 is a side, elevation view of the appliance 200, in this case a domestic dishwasher system partially broken away. The pump system (e.g., pump system 112) and the control circuitry (e.g., the controller 120 and the pump motor control circuit 122) described above and contemplated herein may be practiced in other types of appliances other than just the appliance 200 (and the appliance 100 of FIG. 1 above).

Like numerals are used to identify like components as between the FIGS. 1 and 2, except that the numerals are increased by 100. By way of example, the appliance 200 is coupled to a supply mains 202 and includes a wash zone 204, a spray system 206 for dispensing a washing fluid 208, and a fluid distribution system 210 with a pump system 212 that has at least one pump 214 with a pump motor 216. The pump motor 216 is responsive to an input 218 from a controller 220, which is coupled to the supply mains 102. The controller 220 includes a pump motor control circuit 222 that is configured to provide the input 218 to the pump motor 216, and in one embodiment the input 218 includes a single-phase AC input 224 with a frequency 226 that can vary among a variety of values as selected and implemented by the controller 220. The pump motor control circuit 222 is also configured with component circuitry 228 such as an inverter circuit 230 and a rectifier circuit 232.

Particular to the example of FIG. 2, the wash zone 204 includes a cabinet 234 having a tub 236 therein and forming a wash chamber 238. The tub 236 includes a front opening (not shown in FIG. 2) and a door 240 with a hinged bottom 242 such as for movement between a normally closed vertical position (shown in FIG. 2) wherein the wash chamber 238 is sealed shut for washing operation, and a horizontal open position (not shown) for loading and unloading of dishwasher contents.

Guide rails 244 including an upper guide rail 246 and a lower guide rail 248 are mounted on tub side walls 250. The guide rails 244 accommodate one or more racks 252 such as an upper rack 254 and a lower rack 256 (hereinafter, "the racks"), respectively. Each of the racks is fabricated from known materials into lattice structures including a plurality of elongated members 258, and each is adapted for movement between an extended loading position (not shown) in which at least a portion of the racks are positioned outside the wash chamber 238, and a retracted position (shown in FIG. 2) in which the rack is located inside the wash chamber 238. In one implementation, a silverware basket (not shown) is removably attached to lower rack 256 for placement of silverware, utensils, and the like that are too small to be accommodated by either one or both of the racks contemplated herein.

A control input selector 260 such as a keypad is mounted at a convenient location on an outer face 262 of door 240 and is coupled to known control circuitry, which in one example is coupled to the controller 220. The control input selector 260 is also coupled to other control mechanisms (not shown) for operating, e.g., the pump system 212 for circulating the washing fluid 208 such as water and dishwasher fluid in the tub 236. In one embodiment, at least a portion of the pump system 212 is located in a machinery compartment 264 located below a bottom sump portion 266 of the tub 236.

Construction of the spray system 206 as provided in connection with the concepts of the present disclosure can vary. In one embodiment, the spray system 206 includes a lower or first spray arm 268, which is mounted for rotation within a lower region 270 of the wash chamber 238 and above bottom sump portion 266 so as to rotate in relatively close proximity to the lower rack 256. A mid-level or second spray arm 272 is located in an upper region 274 of the wash chamber 238 in close proximity to the upper rack 254. The mid-level spray arm 272 is located at a height above the lower rack 256 sufficient to accommodate items such as a dish or platter (not shown) that is placed in lower rack 256. In a further embodiment, an upper or third spray arm 276 is located above the upper rack 254, again being located at a height sufficient to accommodate items expected to be placed in the upper rack 254, such as a glass (not shown) of a selected height.

One or more of the spray arms (e.g., the lower spray arm 268, the mid-level spray arm 272, and the upper spray arm 276) are fed by the pump system 212. Each of the spray arms includes discharge ports 278 such as one or more spray jets 280, which are effectively orifices for directing the washing fluid 208 onto dishes located in the racks. In one embodiment, the angle of the spray jets 280 is fixed such as relative to the spray arm. This angle can vary, depending in part on the size of the wash chamber 238, the location of the spray arm, and the number of racks, among many factors. Angles for the spray jets 280 can be from about 5° to about 15°, with one particular construction having one or more of the spray jets 280 affixed at a 10° angle relative to the spray arm.

The arrangement of the spray jets 280 on the spray arms can result in a rotational force as the washing fluid 208 flows through the spray jets 280. The resultant rotation of spray arm provides coverage of dishes and other dishwasher contents with the washing fluid 208. In one embodiment, one or more of the spray arms is configured to rotate, generating in one example a swirling spray pattern above and below, e.g., the upper rack 254 when the pump system 212 is activated.

In one embodiment, the pump 214 is outfitted with a pump stabilizer 282, which is configured to address torque pulsation and related vibration issues, such as those issues discussed above. The pump stabilizer 282 includes one or more masses 284, such as a first mass 286 and a second mass 288, and a mass coupling device 290 that couples each of the masses 284 to the pump 214 and/or pump motor 216. In one embodiment, the combination of the masses 284 and the length of the mass coupling device 290 is selected so as to balance the vibrations associate with, e.g., the torque pulsation. This configuration increases the rotational moment of inertia of the pump 214, counteracting the rotational energy of the pump motor 216 during operation, and effectively reducing vibration and noise associated therewith. An example of one construction of the pump stabilizer 282 is discussed next in connection with FIGS. 3 and 4.

Figure 3:
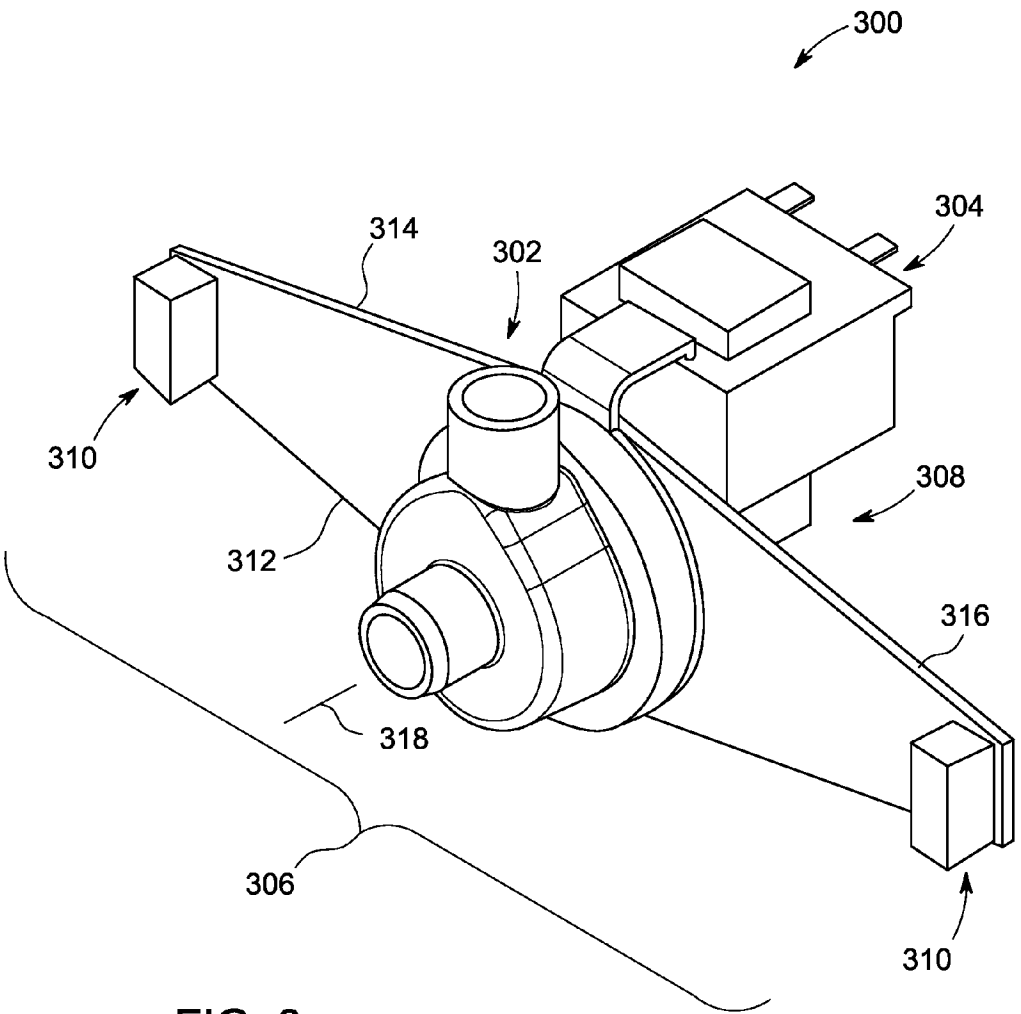
FIG. 3 is a top, perspective view of a pump for use in an appliance such as the appliances of FIGS. 1 and 2.
Figure 4:
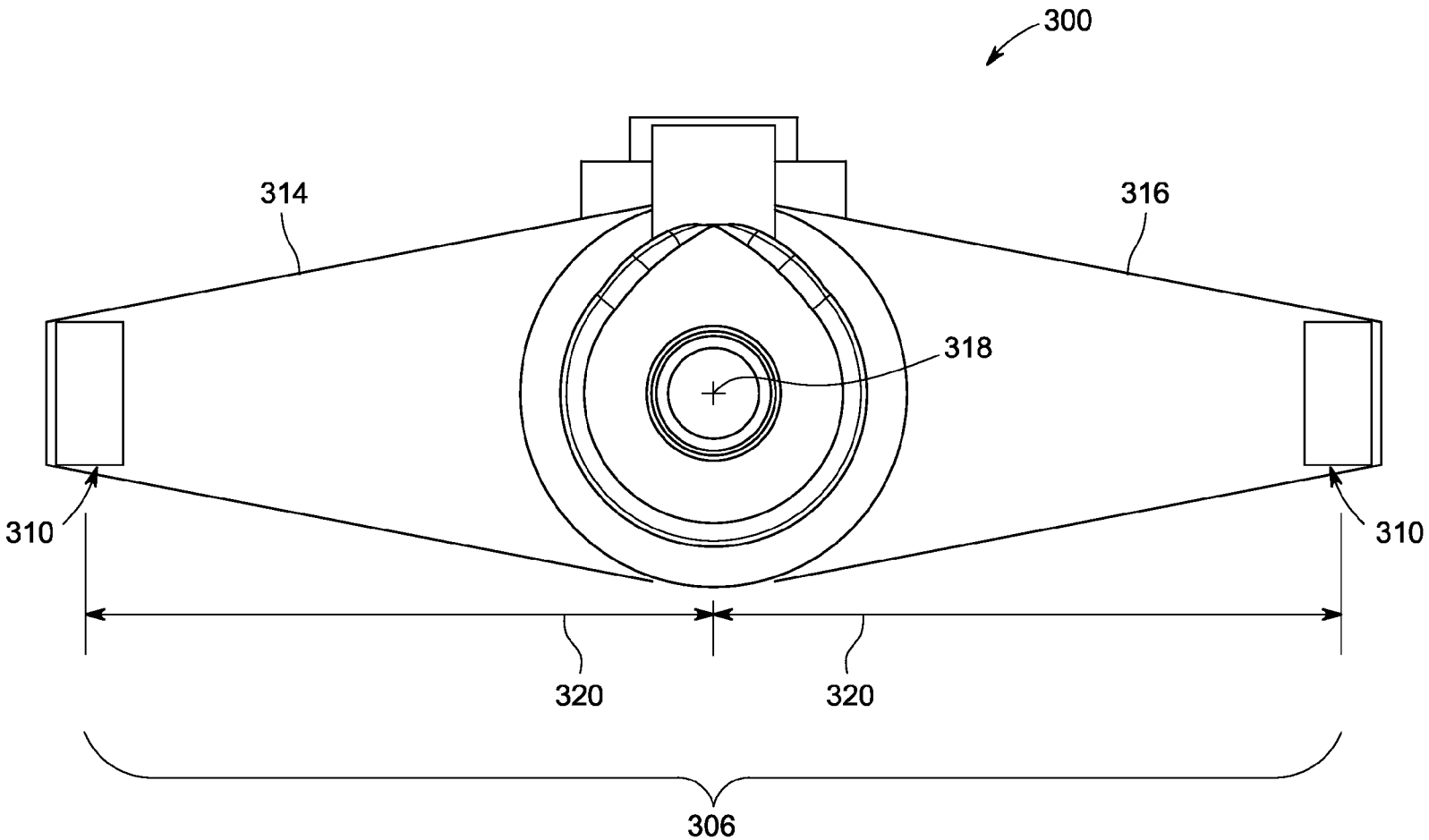
FIG. 4 is a front view of the pump of FIG. 3.

In FIGS. 3 and 4, there is depicted an example of a pump assembly 300, which is sized and configured such as for implementation in the appliance 200 (FIG. 2) discussed above. The pump assembly 300 includes a pump 302 and a pump motor 304, the combination of which is configured to pressurize, e.g., the washing fluid 208 (FIG. 2) for dispersal in the appliance 200 (FIG. 2). The pump assembly 300 also includes a pump stabilizer 306, which includes an outrigger device 308 and a pair of masses 310 coupled thereto. The outrigger device 308 includes a body 312 with a first outrigger arm 314 and a second outrigger arm 316 (collectively, "the elongated arms") that are elongated and extend away from a center line or axis 318 of the pump/pump motor combination. The elongated arms position the masses 310 at a distance 320 (FIG. 4) away from the center axis 318.

As discussed above, the pump stabilizer 306 is configured to reduce and/or negate vibrations that are associated with single-phase motors of the type contemplated and implemented herein. Construction of the components of the pump stabilizer 306 can employ a variety of materials and manufacturing processes, each being selected to provide the general configuration and arrangement of the features disclosed herein. The elongated arms and the masses 310 are amenable, for example, to materials such as metals, plastics, and composites, and more particularly to those materials that are typically related to consumer goods and devices. Therefore selection is often dictated by factors such as cost, size, shape, and reliability. The components can be formed as a single unitary structure, wherein the various members (e.g., the masses 310, the first outrigger arm 314, and the second outrigger arm 316) are formed monolithically with one another. Materials and manufacturing techniques can also be used so that in other constructions, the pump stabilizer 306 is formed as separate pieces that are assembled together with fasteners such as adhesives to secure together the various pieces and components.

Likewise the selected construction can contemplate such considerations as integration with the pump/motor, size constraints associated therewith, as well as operational characteristics that can exacerbate the vibration and pulsation of the motor. At a relatively high level and in one example, selection of the distance 320 can take into consideration that, as the pump/motor rotates to pressurize the washing fluid, it is pulsed on and off such as up to about 120 per second due to the zero-cross of the input power (e.g., 60 Hz AC power). This forcing function results in noise, or in other words, the torque pulsation discussed above. The pump stabilizer 306 configured, however, to counteract the pulsation and in one construction the distance 320 is assigned to position the masses 310 to increase the rotational moment of inertia of the pump/motor device. Because the forcing function does not change, e.g., because the input power remains the same, the increased rotational moment reduces and/or effectively negates the vibration that results from operation of the pump/pump motor, thereby effectively reducing the unwanted noise.

Figure 5:
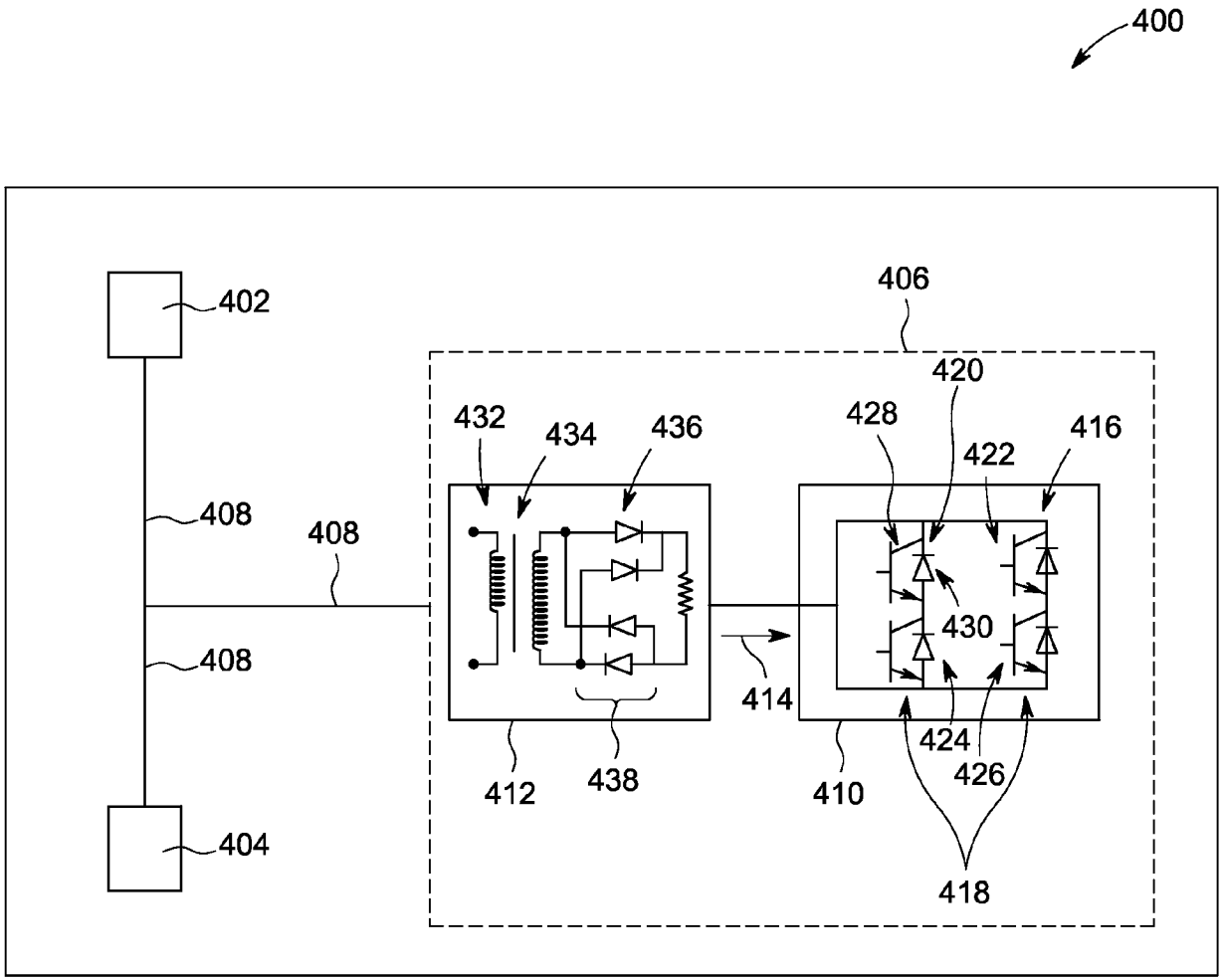
FIG. 5 is a schematic diagram of a controller for use in an appliance such as the appliances of FIGS. 1 and 2.

Referring next to FIG. 5, and generally to FIGS. 1-4, a schematic diagram is provided that depicts one configuration of an exemplary controller 400 for use as, e.g., the controller 120 and 220. When implemented in the appliance 100 and 200 such as coupled to the pump assembly (e.g., the pump assembly 300), the controller 400 effectuates operation of the pump systems to dispense washing fluid, and more particularly to vary the spray velocity of the washing fluid ejected from the spray jet (e.g., spray jets 280). Configurations of the controller 400 generally include one or more groups of electrical circuits that are each configured to operate, separately or in conjunction with other electrical circuits, to selectively vary the frequency and/or voltage of the single-phase AC input 124. In FIG. 5, the controller 400 includes a processor 402, a memory 404, and a pump motor control circuit 406, all of which are coupled together via one or more busses 408. The pump motor control circuit 406 includes an inverter circuit 410 and a rectifier circuit 412 coupled to the inverter circuit 410 to provide a DC input 414 such as from the rectifier circuit 412 to the inverter circuit 410. Details of exemplary construction for each of the inverter circuit 410 and the rectifier circuit 412 is discussed below.

In the present example, the inverter circuit 410 includes an H-bridge inverter circuit 416 that comprises a plurality of switches 418 such as a first switch 420, a second switch 422, a third switch 424, and a fourth switch 426. Selective operation among and combinations of the switches 418 can vary the operation of the pump motor (e.g., the pump motor 116 and 216). These combinations change the voltage and the waveform (or frequency) of the input (e.g., the single-phase AC input 124 and 224) that is supplied to the pump motor. In one embodiment, each of the switches 418 is configured with one or more discrete elements such as a transistor 428 and an inversion diode 430.

The rectifier circuit 412 includes a rectifier circuit 432 such as a full-wave rectifier, which is one of many acceptable ways to rectify AC to DC as contemplated herein. By way of example, the rectifier circuit 432 is constructed using a transformer 434 coupled to a diode bridge 436. In the present example, the diode bridge 436 includes a plurality of rectification diodes 438.

The controller 400 and its constructive components are configured to communicate amongst themselves and/or with other circuits (and/or devices), which execute high-level logic functions, algorithms, as well as firmware and software instructions. Exemplary circuits of this type include, but are not limited to, discrete elements such as resistors, transistors, diodes, switches, and capacitors, as well as microprocessors and other logic devices such as field programmable gate arrays ("FPGAs") and application specific integrated circuits ("ASICs"). While all of the discrete elements, circuits, and devices function individually in a manner that is generally understood by those artisans that have ordinary skill in the electrical arts, it is their combination and integration into functional electrical groups and circuits that generally provide for the concepts that are disclosed and described herein.

The electrical circuits of the controller 400 are sometimes implemented in a manner that can physically manifest theoretical analysis and logical operations such as Fourier analysis, which is useful to facilitate, e.g., the variation of the frequency and/or voltage. These electrical circuits can replicate in physical form an algorithm, a comparative analysis, and/or a decisional logic tree, each of which operates to assign the output and/or a value to the output that correctly reflects one or more of the nature, content, and origin of the changes that occur and that are reflected by the relative inputs to the pump motor as provided by the pump motor control circuit 406.

In one embodiment, the processor 402 is a central processing unit (CPU) such as an ASIC and/or an FPGA that is configured to the control operation of the switches 418. This processor can also include state machine circuitry or other suitable components capable of controlling operation of, e.g., the pump motor 116 and 216 as described herein. The memory 404 includes volatile and non-volatile memory and can be used for storage of software (or firmware) instructions and configuration settings. Each of the inverter circuit 410 and the rectifier circuit 412 can be embodied as stand-alone devices such as solid-state devices. These devices can be mounted to substrates such as printed-circuit boards, which can accommodate various components including the processor 402, the memory 404, and other related circuitry to facilitate operation of the controller 400 in connection with its implementation in the appliance 100 and 200.

However, although FIG. 5 shows the processor 402, the memory 404, the inverter circuit 410, and the rectifier circuit 412 as discrete circuitry and combinations of discrete components, this need not be the case. For example, one or more of these components can be contained in a single integrated circuit (IC) or other component. As another example, the processor 402 can include internal program memory such as RAM and/or ROM. Similarly, any one or more of functions of these components can be distributed across additional components (e.g., multiple processors or other components).

When implemented in the appliance 100 and 200, the controller 400 can be incorporated as part of a control loop (not shown), which is useful to monitor and to modify operation of the appliance 100 and 200 amongst a plurality of operational cycles. In one embodiment, selection of each operational cycle determines values for frequency, voltage, and/or spray velocity. These values can be stored in the processor 402 and/or the memory 404, such as in one example wherein the values are pre-set by way of factory settings and/or calibration such as by way of firmware or other executable instructions. The values can also be assigned by an end user. Selection of the operational cycle is also end user driven, that is the control loop and/or the controller 400 is operatively arranged to receive, process, and implement selection by the user of the operational cycle via, e.g., the control input selector 260. This selection effectuates in the controller 400, for example, one or more expected values for the frequency and/or voltage of the single-phase AC input (e.g., the single phase AC input 124 and 224), which in turn causes variations in the operation of the pump motor as outlined above, and ultimately results in changes in the spray velocity of the washing fluid realized at the spray jets.

These changes can occur within specified parameters established, defined, determined, and/or set by the operational cycle. In one embodiment, the parameters identify one or more threshold values for the frequency, as well as timing and related characteristics that regulate the time for which the single-phase AC input (e.g., the single-phase AC input 124 and 224) is impressed at the desired frequency and/or voltage upon the pump motor (e.g., the pump motor 116 and 216). In one example, the operational cycle varies the frequency as between a maximum value and a minimum value, with the operation at the maximum and minimum values being assigned particular amounts of time. In another example, the operational cycle and/or the values for frequency are assigned by way of a waveform such as a sine wave or square wave that defines the changes of the frequency (e.g., the frequency 126 and 226) for the single-phase AC input impressed upon the pump motor.

Figure 6:
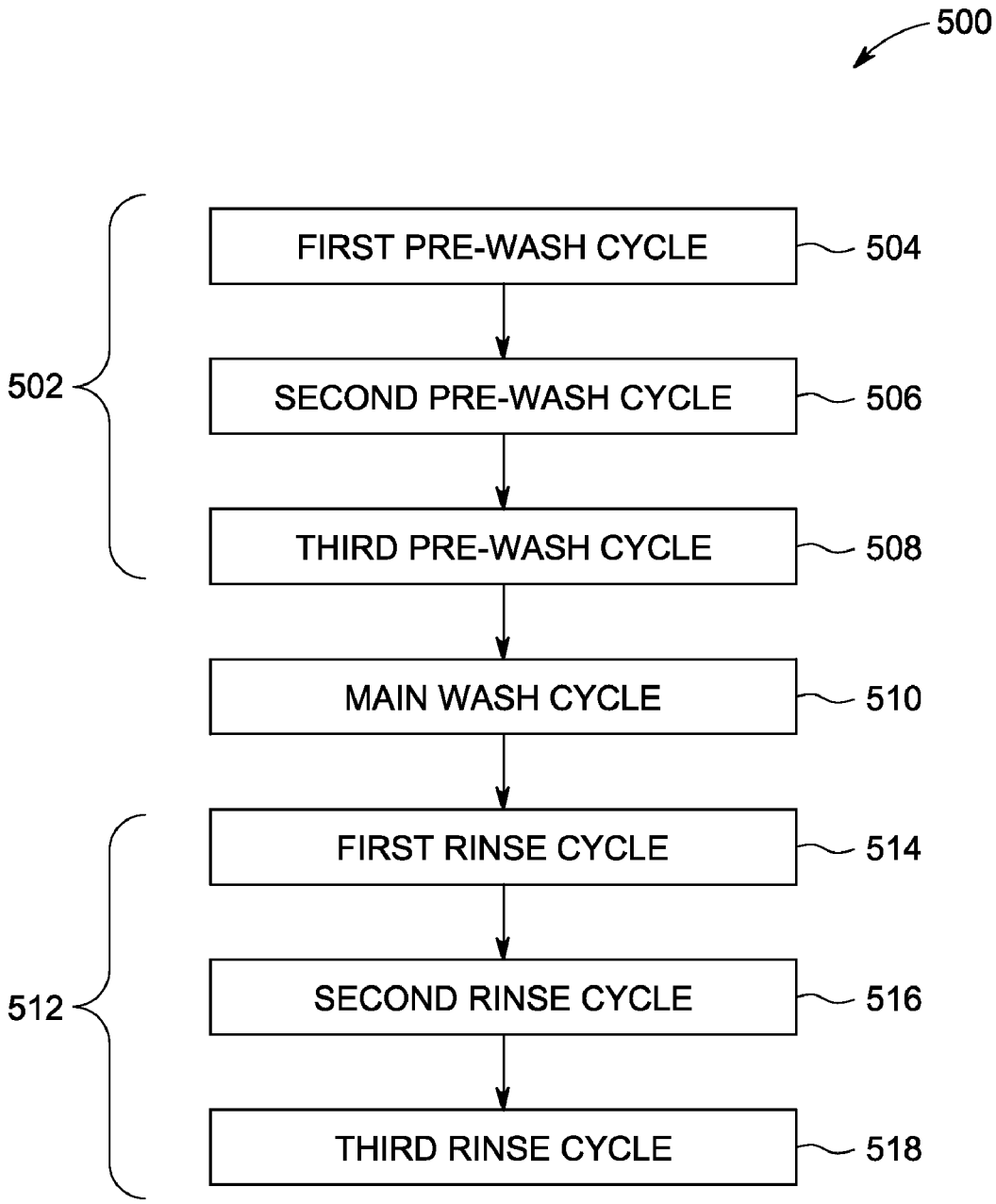
FIG. 6 is a flow diagram of an exemplary operational cycle for implementation on an appliance such as the appliances of FIGS. 1 and 2.

To illustrate the operation of appliances under operational cycles contemplated herein, reference can now be had to FIG. 6 in which there is depicted an example of an operational cycle 500. Typically, operational cycles for dishwashing appliances employ a series of different cycles and/or portions, which include pre-wash, main wash, and rinse cycles having a preset operation time in which the washing fluid is dispersed into the wash zone. As described above, the pumps employed in the appliances may be controlled based upon the desired operational cycle of the appliance. In particular, the frequency is varied to change the rotational speed of the pump motor of the pumps, which in effect changes the spray velocity of the washing fluid that is ejected from the spray jet.

In the illustrated embodiment, the operational cycle 500 includes a pre-wash portion 502 that is effectuated by a first pre-wash cycle 504, a second pre-wash cycle 506, and a third pre-wash cycle 508. The pre-wash portion 502 is used to remove loose particles from the dishes. Further, the operational cycle 500 includes a main wash cycle 510 for washing the dishes. In addition, the operational cycle 500 includes a rinse portion 512, including in this example a first rinse cycle 514, a second rinse cycle 516, and a third rinse cycle 518.

As will be appreciated by one skilled in the art based upon a desired flow rate for each of these cycles, pumps for each of the spray arms may be controlled by the controller 120 (FIG. 1), 220 (FIG. 2), and the controller 400 (FIG. 3) thereby optimizing the amount of water and energy for the operational cycle 500 of the appliances. As illustrated, the operational cycle 500 includes three pre-wash cycles, a main wash cycle and three rinse cycles having a pre-determined running time. However, the appliances may employ a greater or lesser number of such cycles. Again, based upon the number of cycles and the desired flow rate of water, the pump(s) for the spray arms are selectively controlled during operation of the appliances disclosed herein.

Figure 7:
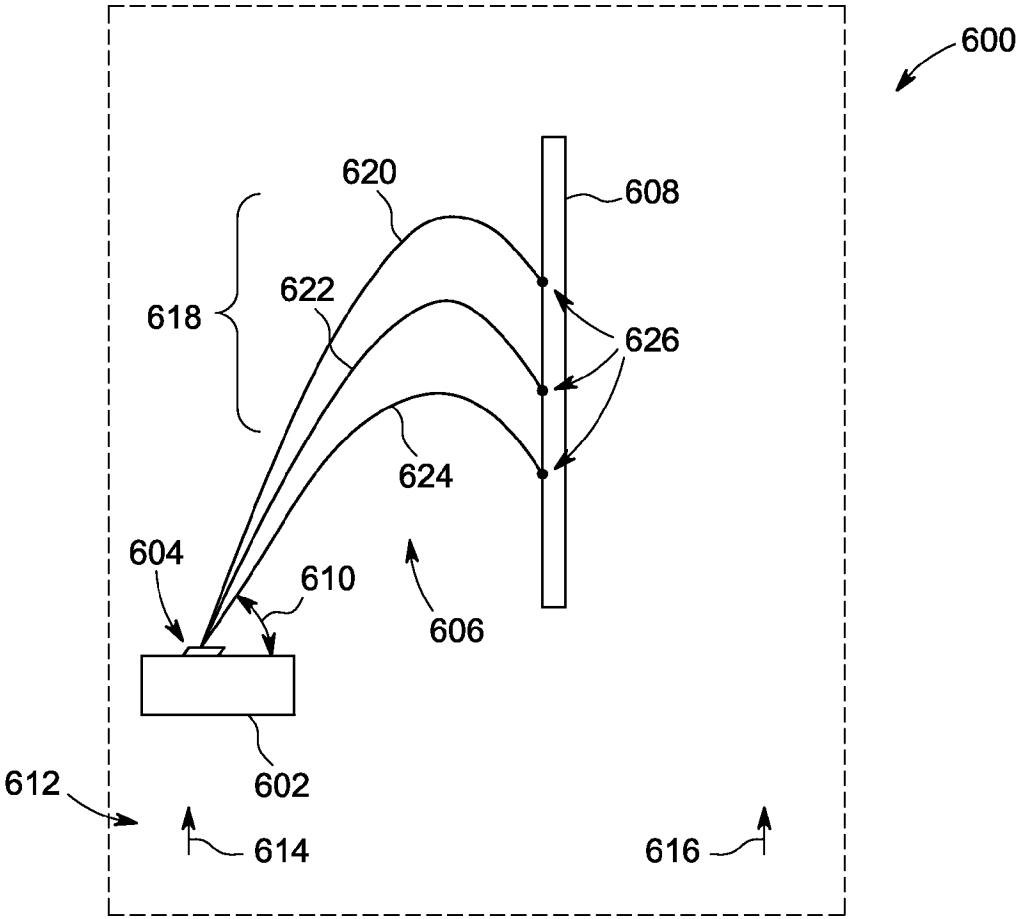
FIG. 7 is a schematic, partial diagram of yet another exemplary embodiment of an appliance for washing objects.

Concepts related to the change in the spray velocity that result from changes in the operation of the pump/pump motor are further discussed in connection with FIG. 7 below. In FIG. 7, there is depicted at a high level an exemplary embodiment of an appliance 600, shown as a schematic, partial diagram to illustrate one or more of the concepts disclosed herein. The appliance 600 can include a variety of components similar to those found in the appliance 100 and 200 discussed above. However, most of these components are removed for clarity, the discussion being instead focused on the spray jet and the spray velocity of the washing fluid dispersed therethrough.

The appliance 600 includes a spray arm 602 with a spray jet 604 from which is ejected a washing fluid 606 onto an object 608. The spray jet 604 is fixed at an angle 610, which is measured relative to the spray arm 602, and is located at a spray jet position 612, which is measured relative to the object 608. The spray jet position 612 varies as between a first position 614 and as a second position 616 such as in response to rotation of the spray arm 602. The washing fluid 606 is ejected from the spray jet 604 as a plurality of washing streams 618 including a first washing stream 620, a second washing stream 622, and a third washing stream 624.

Each of the washing streams 618 originate from the same spray jet 604 but impinge onto the object 608 at different location as indicated by the plurality of washing stream locations 626 depicted in the present example. The washing stream location 626 for each of the washing streams 618 is defined by the angle 610 and a spray velocity at which the washing fluid 606 is ejected from the spray jet 604. In one embodiment, the spray velocity of the first washing stream 620 is greater than the spray velocity of the second washing stream 622, which is in turn greater than the spray velocity of the third washing stream 624. The change in the spray velocity likewise changes the washing stream location 626 as between each of the washing streams 618.

In operation, movement of the spray arm 602 and changes in the spray velocity can increase coverage of the washing fluid 606 on the object 608. The combination can change the washing stream location 626 so that the washing fluid 606 impinges on all parts of the object 608. For example, increasing and decreasing the spray velocity, in combination with movement of the spray jet 604 between the first position 614 and the second position 616, can change the washing stream location 626 so that most points on the object 608 are subject to the washing fluid 606.

In view of the foregoing, pumps that are implemented in the pump systems disclosed above are configured to change the spray velocity of the washing fluid in response to the variable frequency, single-phase alternating current. These pumps, and the accompanying control circuitry permit operation of the dishwasher system in a manner that is as effective as conventional appliances, as discussed in EXAMPLE I below. Change in spray velocity can be determined in connection with the operational cycle selected and/or by way of programming (e.g., executable instructions) implemented by control circuitry of the type contemplated herein. In some implementations of the concepts, the simplicity of the control circuitry permits more than one pump to be employed such as wherein the washing fluid is provided to each spray arm by a separate pump. By operating the spray arms independent of one another, dishwasher systems can operate in a cost effective and reliable manner.

EXPERIMENTAL SECTION

For further clarification, instruction, and description of the concepts above, embodiments of the present disclosure are now illustrated and discussed in connection with the following examples. Note that any dimensions provided in connection with these examples are exemplary only and should not be used to limit any of the embodiments of the invention, as it is contemplated that actual dimensions will vary depending on the practice and implementation of the concepts discussed herein as well as variety of factors such as, but not limited to, the size of the appliance, the rating and size of pump, the desired flow rate of the washing fluid, and the like.

Example I

Implementation of the concepts above, including the use of a pump responsive to a variable frequency, single-phase AC input, was compared to conventional dishwashers using a wash index value. Typically, the wash index value is estimated by way of a washability test in which food items are applied on dishes about 24 hours prior to the washability test and are then washed in the appliance. The washed dishes are graded at the end of the cycle for estimating the wash index value. The dishes are graded on a scale of 0, 3, and 8, wherein 0 is assigned to a perfectly clean dish, 3 is assigned to a dish where any remaining soil can be flicked off with relatively little effort, and 8 being assigned to a dish where any remaining soil regardless of its size cannot be flicked off the dish or can be flicked off but leaves a mark on the dish.

The grading is performed for all the dishes washed in the dishwasher and the wash index value is estimated by the following Equation 1 in which, $$WashIndex = 100\left(1 - \frac{a}{8N}\right), \quad \text{Equation 1}$$

wherein a is the summation of all assigned points and N is the number of dishes in the load for the cycle of the dishwasher.

Table 1 illustrates the wash index value for a conventional dishwasher (Washer 1) and for an appliance (Washer 2), which has a set-up comparable to the Washer 1 but in which is included a pump (e.g., the pump 114 (FIG. 1), the pump 214 (FIG. 2), and the pump assembly 300 (FIGS. 3 and 4)) responsive to a variable frequency, single-phase AC input. In the present Washer 1 and Washer 2, the spray jets are affixed at a fixed angle relative to the spray jets such as at about 10°.

TABLE 1

| Trial | Washer 1 | Washer 2 |
|---|---|---|
| Trial 1 | 84 | 38 |
| Trial 2 | 84 | 34 |
| Trial 3 | 81 | 41 |
| Trial 4 | 87 | 70 |
| Trial 5 | 88 | 74 |

The inventors note that the wash index value for the Washer 2 improved by almost 2 times from the first trial (Trial 1) to the fifth trial (Trial 5). This improvement is indicative of changes to the spray velocity of the spray jets, wherein the changes are effectuated, at least in part, by changes in the frequency of the single-phase alternating current (AC) input that is impressed upon the pump. Focusing on the results of Trial 5, it is further evident that implementation of the concepts herein can result in cleanliness that is comparable to conventional dishwashers (e.g., Washer 1). That is, the inventors further note herein that the improvement in the cleanliness scores as between Trial 1 and Trial 5 for Washer 2 indicate that further configurations of, for example, the operational cycle may generate cleanliness scores on the order of at least, if not in excess of, those cleanliness scores of conventional dishwashers while at a reduced cost and complexity.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An appliance, comprising:

a pump configured to pressurize a washing fluid;

a spray arm in fluid communication with the pump, the spray arm comprising a spray jet through which flows the washing fluid at a spray velocity and an angle fixed relative to the spray arm; and a controller with a pump motor control circuit coupled to the pump and configured to generate a variable frequency, single-phase alternating current input, the controller comprising a processor, memory coupled to the processor, and executable instructions stored on memory and configured to be executed by the processor, the executable instructions comprising instructions for implementing an operational cycle that assigns values to the frequency of the variable frequency, single-phase alternating current input to eject the washing fluid at different washing stream locations on an object, and wherein the pump is configured to change the spray velocity of the washing fluid in response to the frequency of the variable frequency, single-phase alternating current input.

2. An appliance according to claim 1, wherein the pump motor control circuit is configured to receive an input from a supply mains.

3. An appliance according to claim 1, wherein the pump motor control circuit comprises a rectifier and an inverter coupled to the pump.

4. An appliance according to claim 3, wherein the inverter comprises an H-bridge inverter circuit.

5. An appliance according to claim 3, wherein the rectifier comprises a full-wave rectifier.

6. An appliance according to claim 1, wherein the pump comprises a synchronous motor.

7. An appliance according to claim 1, wherein the angle of the spray jet is at least about 10°.

8. An appliance, comprising:

a first spray arm and a second spray arm, each having a spray jet through which a washing fluid is dispersed at a spray velocity and a fixed angle;

a pump system configured to pressurize the washing fluid; and a controller coupled to the pump system to impress upon the pump system a variable frequency, single-phase alternating current input, the controller comprising a processor, memory coupled to the processor, and executable instructions stored on memory and configured to be executed by the processor, the executable instructions comprising instructions for implementing an operational cycle that assigns values to the frequency of the variable frequency, single-phase alternating current input to eject the washing fluid at different washing stream locations on an object, and wherein the pump system is configured to change the spray velocity of the washing fluid in response to the frequency of the variable frequency, single-phase alternating current input.

9. An appliance according to claim 8, further comprising a rectifier coupled to an inverter, wherein the rectifier is configured to convert an alternating current input to a direct current input impressed upon the inverter.

10. An appliance according to claim 8, wherein the pump system comprises a pump coupled to each of the first spray arm and the second spray arm.

11. An appliance according to claim 8, wherein the operational cycle includes one or more of a pre-wash cycle, a wash cycle, and a rinse cycle.

12. An appliance, comprising:

a spray arm configured to disperse a washing fluid at a spray velocity and angle that is fixed relative to the spray arm;

a pump in fluid communication with the spray arm, the pump comprising a pump motor responsive to a variable frequency, single-phase alternating current input;

a controller coupled to the pump to impress the variable frequency, single-phase alternating current input upon the pump motor, the controller comprising a processor, memory coupled to the processor, and executable instructions stored on memory and configured to be executed by the processor, the executable instructions comprising instructions for implementing an operational cycle that assigns values to the frequency of the variable frequency, single-phase alternating current input to eject the washing fluid at different washing stream locations on an object, and a pump stabilizer coupled to the pump motor, wherein the pump is configured to change the spray velocity of the washing fluid in response to the frequency of the variable frequency, single-phase alternating current input.

13. An appliance according to claim 12, wherein the pump stabilizer comprises a mass coupled to and spaced apart from the pump motor.

14. An appliance according to claim 12, wherein the pump stabilizer comprises a first mass, a second mass, and a mass coupling device, and wherein the mass coupling device secures to the pump motor the first mass and the second mass.

* * * * *